US005259224A

United States Patent [19]

Schwarze

[11] Patent Number: 5,259,224

[45] Date of Patent: Nov. 9, 1993

[54] METHOD AND APPARATUS FOR CONTROLLING A PIPE BENDING MACHINE

[76] Inventor: Rigobert Schwarze, Olpener Strasse 460-474, DE-5000 Koeln 91, Fed. Rep. of Germany

[21] Appl. No.: 929,546

[22] Filed: Aug. 14, 1992

[30] Foreign Application Priority Data

Sep. 5, 1991 [DE] Fed. Rep. of Germany ..... 4129478

[51] Int. Cl.[5] ..... B21B 37/12

[52] U.S. Cl. ..... 72/24; 72/149; 72/369; 72/8

[58] Field of Search ..... 72/149, 8, 11, 23, 21, 72/22, 24, 369

[56] References Cited

U.S. PATENT DOCUMENTS

| | | | |
|---|---|---|---|
| 2,810,422 | 10/1957 | Bower | 72/23 |
| 3,766,764 | 10/1973 | Ross et al. | 72/22 |
| 3,821,525 | 6/1974 | Eaton et al. | 72/8 |
| 4,563,891 | 1/1986 | Schwarze | 72/149 |

FOREIGN PATENT DOCUMENTS

| | | | |
|---|---|---|---|
| 2304838 | 2/1973 | Fed. Rep. of Germany . | |
| 0205620 | 11/1983 | Japan | 72/8 |

*Primary Examiner*—Lowell A. Larson
*Assistant Examiner*—Michael J. McKeon
*Attorney, Agent, or Firm*—Diller, Ramik & Wight

[57] ABSTRACT

A pipe bending machine has a bending template (10) around which a pipe (13) is bent. The bending template (10) is provided with a position sensor (32) that detects the bending path in dependence on the rotational position. A pushing device (17) engages the unbent portion (13*a*) of the pipe and urges the same towards said bending template (10). The pushing device (17) is provided with a position sensor (30). The position signals (PS1, PS2) of the two position sensors (32, 30) are compared in a control circuit (41) and an actuation signal (SS) is generated for controlling a pressure controller (42) to adjust the pressure of the drive (22) of the pushing device (17). The actuation signal (SS) is generated such that, in the case of equal position signals (PS1, PS2), the drive (22) of the pushing device (17) is supplied with a pressure that determines the upsetting force exerted on the pipe.

7 Claims, 2 Drawing Sheets

METHOD AND APPARATUS FOR CONTROLLING A PIPE BENDING MACHINE

BACKGROUND OF THE INVENTION

The invention relates to a method for controlling a pipe bending machine and, in particular, to a pipe bending machine for the pressure bending of pipes.

When bending pipes, a clamping jaw presses a pipe laterally against a bending template which is then turned, the clamping jaw performing a pivotal movement. When the bending template is turned, the pipe is bent around the bending template. With thin pipe walls, small bending radii, large pipe diameters and sensitive pipe materials, pressure bending is used in which a pushing device urges the unbent pipe section towards the bending template during the bending operation. Here, the feed of the pushing device is effected at a speed that is slightly higher than would correspond to the turning speed of the bending template so that, during the bending operation, the pipe is subjected to a slight upsetting in the longitudinal direction. Here, the mutual tuning between the turning movement of the bending template and the feed movement of the pushing device is of particular importance. Should the pushing device be advanced too fast or too slowly, cracks, corrugations or areas of different wall thicknesses may occur.

From German Patent 23 04 838 C2, a pipe bending device is known wherein the feed movement of the pushing device is tuned to the turning movement of the bending template. For this purpose, sensors are provided that determine the circumferential velocity and the up-setting speed from the bending angle of the bending template and the upsetting path of the pushing device. By a comparison, the difference between both velocities is formed and a servo valve is controlled in dependence on this difference, the servo valve being designed as a volume controlling valve and changing the backflow volume of the hydraulic drive of the pushing device. Thus, the measured values evaluated are velocities and the actuation signal causes a change in the rate of flow, i.e., the backflow volume of the hydraulic oil from the drive of the pushing device. It is a drawback of such a velocity control that an erroneous upsetting force once established is maintained throughout the entire pipe bending process even if the two velocities are subsequently maintained in the correct relation to each other. This means that instantaneously occurring errors are not corrected by the control system. The feed velocity of the pushing device is changed by the volume control means. However, such a flow rate control has the drawback of being comparatively inert (slow) and inaccurate and that it may occur that the flow rate predetermined by the control means is temporarily not attained because the resistance of the pushing device and the pipe is too strong. In this case, no posterior correction and no "catching up" is performed.

SUMMARY OF THE INVENTION

It is an object of the invention to provide a control method allowing to obtain a high uniformity of the bending process and the pushing operation in pressure bending, possible deviations being made up for or balanced immediately.

In the present control method for a pipe bending machine, the position signals of the bending template and the pushing device are detected and are processed to generate the actuation signal without velocity signals being formed from the position signals by integration or the like. One of the two drives is used as a guiding drive and the other drive is used as a follow-up drive. By the processing of the position signals, it is possible to achieve that, during the entire bending operation, a position signal of the bending template must correspond to a position signal of the pushing device, respectively. Thus, the pairs of position signals are fixedly assigned to each other. In case of a deviation, an immediate correction is effected so that previous deviations do not continue into the future. The actuation signal generated in dependence on the position signals controls the supply pressure of the follow-up drive. This means that the supply pressure is changed in dependence on the actuation signal, this dependence preferably being linear. Yet, other control is possible, for example a PID control, in order to provide a faster compensation for deviations. The pressure control is easy and precise, since controllable pressure controllers with the required accuracy are available.

The position signal of the bending template may be determined, for example, by a rotation angle sensor that responds to the turning of the bending template. The position signal of the pushing device is determined by a path sensor. When determining the position signal of the bending template, one must of course take into account the diameter of the bending template and the diameter of the pipe to be bent, since the comparison of the positions is to be based on the bending radius of the pipe axis in the area of bending. Thus, the position signal of the bending template that is used as a basis of the evaluation is obtained only after a multiplication of the signal sensor signal by a factor corresponding to the mean bending radius.

If the position control were effected such that both position signals were always equal, the pushing device would not exert an upsetting pressure on the pipe. For this reason, the control is effected such that the feed position that the pushing device has to take is slightly larger over the greater part of the feed path or the bending length than the feed or turning position of the bending template. The rigidity of the pipe prevents the pushing device to actually reach its respective set value with respect to the guiding signal derived from the turning of the bending template. The difference between the actual and the set values of the pushing device position maintains the upsetting pressure which is proportional to the lag of the pushing device caused by the pipe. Thus, the upsetting pressure is caused by forcing the pushing device to take a positional lead over the bending template that is never reached, however, and that in turn maintains a certain bias pressure in the drive of the pushing device. In this manner, the feed or upsetting pressures are kept at a constant value. It is possible to change this value during the bending operation in accordance with a predetermined program sequence.

The invention further relates to a pipe bending machine for pressure bending a pipe. Here, position sensors for detecting the positions of the bending template and the pushing device are connected to a control device in which the difference between the position signals is formed and which controls a controllable pressure controller in dependence thereon to change the supply pressure of one of the two drives. Again, the control is such that the position of the pushing device must exceed that of the bending template during the greater part of the bending operation so that the pressure controller is always instructed to provide pressure.

There need not be a predetermined difference by which the position signals have to differ, but there may also be predetermined a percentage. It is essential only that the control is such that a higher target value is given for the position signal of the pushing device than for the position signal of the bending template corresponding to that position.

An embodiment of the present invention will now be described in detail with reference to the accompanying drawings in which:

DESCRIPTION OF THE PREFERRED EMBODIMENT

Figure 1:
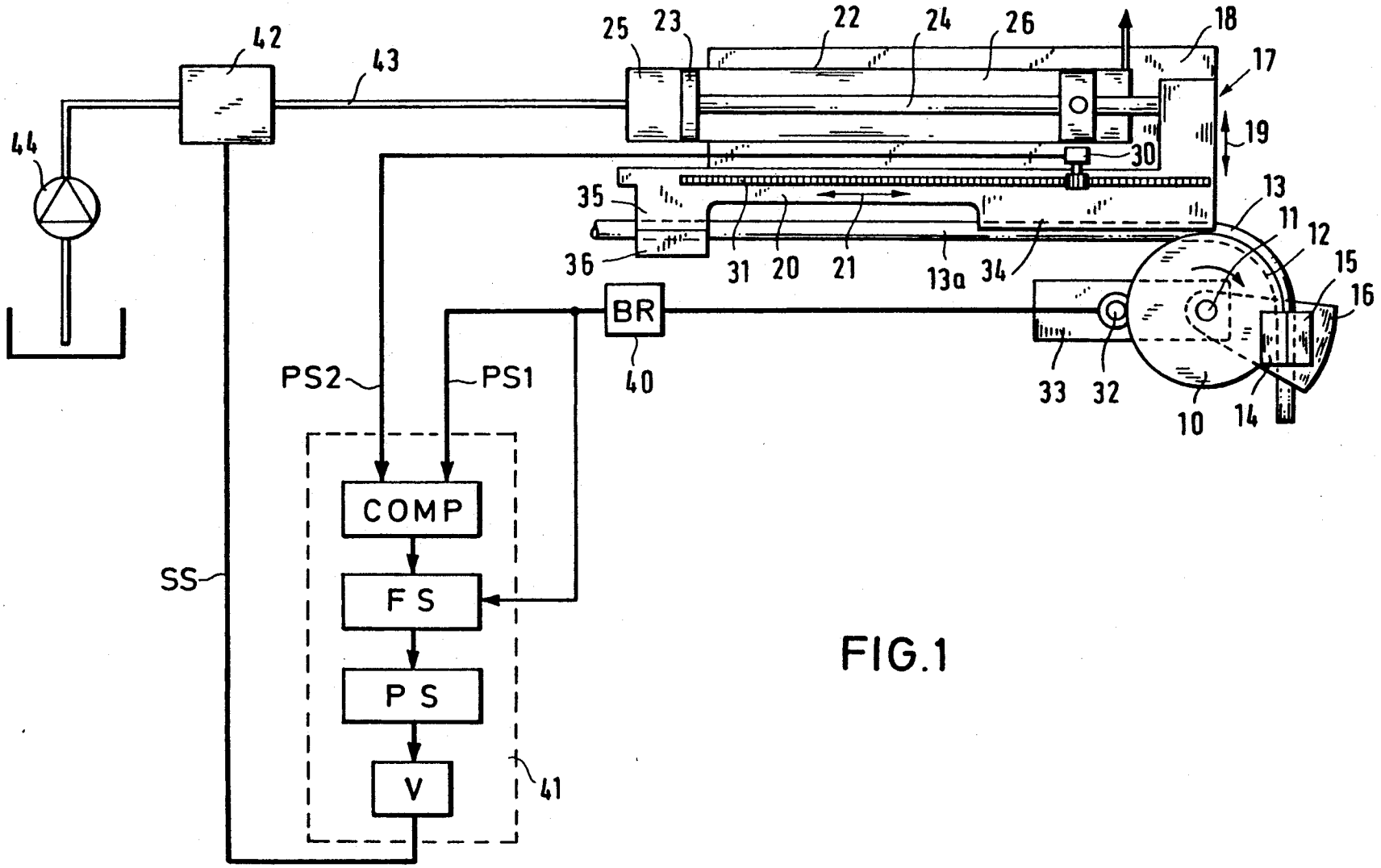
FIG. 1 is a schematic illustration of a pipe bending machine incorporating the control of the pushing device according to the present invention.

The pipe bending machine schematically represented in FIG. 1 includes a bending template 10 rotatably mounted on a machine table (not illustrated). The bending template 10 provided with a vertical axis of rotation 11 is substantially in the shape of a cylindrical body, the circumferential surface of which is provided with a bending groove 12 that receives about one half of the cross section of the pipe 13 to be bent. A counter clamping jaw 14 is mounted at the bending template 10, with which jaw 14 a clamping jaw 15 cooperates so as to commonly enclose the pipe 13 and to clamp it for the bending operation. The clamping jaw 15 is mounted at a pivot arm 16 pivotable about an axis that is coaxial with the axis of rotation 11 of the bending template 10. The clamping jaw 15 is radially movable at this pivot arm 16 for clamping or releasing the pipe.

The unbent portion 13*a* of the pipe 13 is supported by a pushing device 17. The pushing device comprises a carriage 18 that is displaceable transversal to the pipe portion 13*a* in the direction of the double arrow 19. The carriage 18 bears an under-carriage 20 that is displaceable longitudinal to the unbent pipe portion 13*a*, i.e., in the direction of the double arrow 21, as well as a drive 22 for moving the under-carriage 20. The drive 22 is designed as a piston cylinder unit fixedly arranged at the carriage 18, the piston 23 engaging the under-carriage 20 via the piston rod 24 in order to displace the under-carriage. The cylinder of the drive 22 has a working chamber 25 and a return stroke chamber 26, separated by the piston 23.

Further, a position sensor 30 is mounted on the carriage 18, which cooperates with a position measuring strip 31 provided at the under-carriage 20. In the present embodiment, the position measuring strip 31 is a rack driving a pinion of the position sensor 30 when the under-carriage 20 is moved longitudinally, whereby pulses are generated in the sensor, the number of which being a measure of the position of the undercarriage 20.

A further position sensor 32 is arranged on the bending template 10. This position sensor 32, includes, for example, a rotation angle encoder that indicates the rotational position of the bending template 10. The bending template 10 is rotated by a hydraulic drive 33.

A slide rail 34 is provided at the under-carriage 20 near the bending template 10, pressing against the pipe 13 from the side averted from the bending template 10 and supporting the unbent pipe portion 13*a* during the bending operation. The under-carriage 20 is further provided with a pushing element 35 engaging the rear part of the unbent pipe portion 13*a*. The pushing element 35 may comprise a clamping jaw 36 for firmly clamping the pipe portion 13*a*. It is designed such that it engages the pipe without allowing sliding.

In the bending operation, the straight pipe is clamped between the clamping jaw 15 and the counter clamping jaw 14. Thereafter, the bending template 10 is turned according to a predetermined program, the pipe being bent around the bending template 10 and the straight pipe portion 13*a* being moved forward simultaneously. During the bending operation, the under-carriage 20 is advanced parallel to the pipe portion 13*a* by the hydraulic drive 22. This feed is effected in such a manner that the pipe 13 is pushed by the pushing element 35, the pipe portion 13*a* being upset thereby.

The signal from the position sensor 32 is processed in a processing unit 40, in which the bending radius BR is stored, to be the first position signal PS1. The bending radius takes into account the radius of the bending template 10, as well as the diameter of the pipe to be bent. The bending radius is the radius by which the central axis of the pipe is bent and the position signal PS1 indicates the path the pipe has travelled around the bending template 10 since the start of the bending operation.

The second position signal PS2 corresponds to the output signal from the position sensor 30. It corresponds to the path the under-carriage or the pushing element 35 has travelled since the beginning of the bending operation.

The position signals PS1 und PS2 are supplied to a control unit 41 where they are compared by a comparator COMP. The output signal of the comparator is compared to the signal stored in a function memory FS and the difference signal between the function signal stored in the function memory FS and the output signal of the comparator COMP is processed together with a signal taken from a parameter memory PS. The parameter memory PS contains manually inputted parameters, for example, a material parameter MP of the pipe 13, a wall thickness parameter WSP, a diameter parameter DP of the pipe 13 and a bending radius parameter BRP. The signal thus obtained is amplified by an amplifier V and fed as an actuation signal SS to a pressure controller 42 that controls the supply pressure in a pressure line 43 leading from a pressure source 44, e.g., a pump, to the working chamber 25 of the drive 22, to a value proportional to the actuation signal SS.

The control of the pipe bending machine operates as follows:

The drive 33 of the bending template 10 operates under positive control, i.e., it either works at constant velocity or at varying velocities and, if required, rest periods according to a program operating in dependence on the rotational angle of the bending template 10. In dependence on the rotational angle established by the drive 33, the processing circuit 40 generates the position signal PS1, taking the bending radius BR into account, the position signal indicating the rotational path of the pipe 13 around the bending template 10. The position signal PS1 represents the reference input for the control means 41. It is supplied to the function memory FS so as to read the function values therefrom that are stored for the individual positional values. The comparator COMP compares the position signals PS1 and PS2 and supplies a difference signal to the function memory FS. This difference signal is compared to the function value corresponding to the position signal PS1 and the difference signal obtained then is processed in the parameter memory PS with the corresponding material parameters MP, DP, WSP and BRP in order to generate the actuation signal SS. This actuation signal SS sets a corresponding pressure at the pressure controller 42, which is then supplied to the piston 23 of the drive 22.

Figure 2:
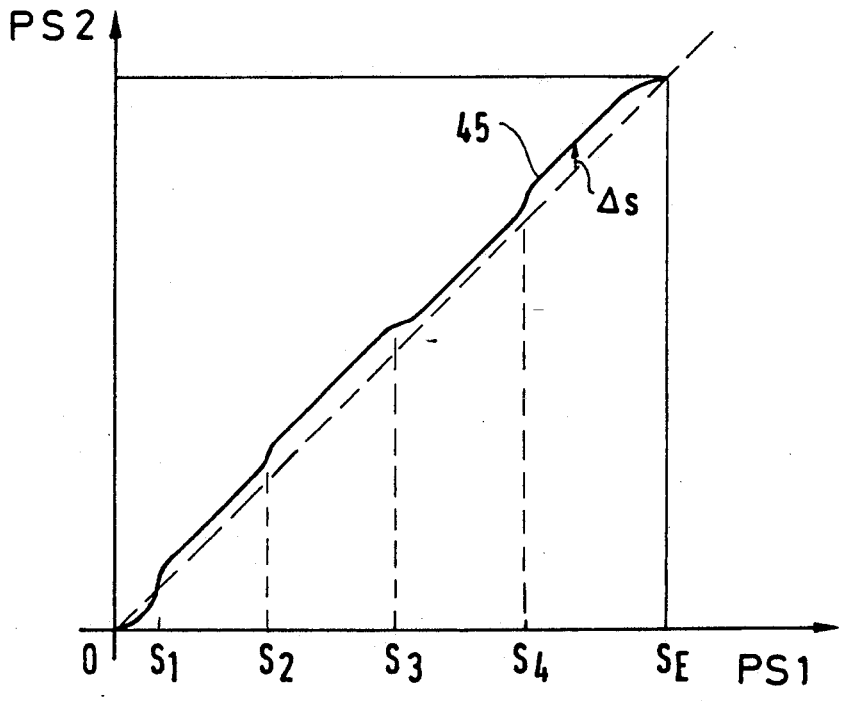
FIG. 2 is a diagram of the feed path of the pushing device and the rotation path of the pipe on the bending template according to a relation stored in a function memory.

FIG. 2 illustrates the relation between the position signals PS2 and PS1. The line of 45° at which the position signals PS1 and PS2 are equal is represented by broken lines. The graph 45 indicates, with respect to the line of 45°, the contents of the function memory FS for the individual position signals PS1. The position signal PS1 is the reference input and the position signal PS2 assumes a value that depends on the feed resistance of the pipe. If the control were such that the values of PS1 and PS2 are equal, the graph 45 would trace the broken line of 45°. In this case, the pushing element 35 and the clamping jaw 14—each with respect to its initial position—would take the same positions along the path, yet, the pipe would not be pushed with pressure so that no pressure bending would take place. In order to perform pressure bending, the graph 45 deviates from the line of 45°. In the beginning of the bending operation, first, only the bending template 10 is rotated, while the drive 22 for the pushing device is not yet pressurized. Therefore, the graph 45 extends below the line of 45° up to a value $S_1$ of the position signal PS1. After this initial phase, the graph 45 extends above the line of 45°. In the function memory FS, the difference (PS1–PS2) is compared to the function signal Δs and the difference (PS1+Δs−PS2) is formed as the control signal. In other words: The set value that the position signal PS2 should assume at the point determined by PS1 is made equal to (PS1+Δs). In the parameter memory PS, the deviation of the actual signal PS2 from this set signal is multiplied by the corresponding parameters and is then outputted as the actuation signal SS. Were the position signals PS1 and PS2 equal, a set signal would be generated that would correspond to the function signal Δs, which would cause the pressure controller 42 to generate a corresponding feed pressure in the working chamber 25 for the pushing device 17.

The graph 45 of FIG. 2 illustrates that in different phases of the bending operation, i.e., in different regions of the first, position signal PS1, different function signals Δs are generated. These different regions of the position signal PS1 are the regions 0-$S_1$, $S_1$-$S_2$, $S_2$-$S_3$, $S_3$-$S_4$ and $S_4$-$S_E$. $S_E$ is the end position where the bending operation is ended. The values Δs, i.e., the desired deviations of the position signal PS2 from the position signal PS1 are stored in the function memory FS in dependence on the position signal PS1, for example, in a ROM or as a function graph or a cam disk.

In general, it is also possible to store a constant value of Δs in the function memory so that with equal position data PS1 and PS2 a constant pressure is always exerted on the piston 23, the pressure urging the unbent pipe portion 13*a* towards the bending template.

What is claimed is:

1. A method of controlling a pipe bending machine comprising a rotatable bending template (10) and a clamping jaw (14) for pressing a pipe (13) against said bending template (10), a bending template drive (33), a pushing device (17) advanced by a fluid pushing device drive (22) and engaging an unbent portion (13*a*) of the pipe, wherein a first measured value is obtained from the rotation of the bending template (10) and a second measured value is obtained from the advancement of the pushing device (17), and an actuation signal for controlling the pushing device drive (22) is obtained form the difference between the two measured values, the measured values processed are position signals (PS1, PS2) of the bending template (10) and the pushing device (17), respectively, and the actuation signal (SS) changes the supply pressure of the pushing device drive (22) in dependence upon the difference of the position signals (PS1, PS2).

2. The method of claim 1, characterised in that the actuation signal (SS) is generated such that it effects a lead of the drive (22) of said pushing device (17) over the drive (33) of said bending template (10).

3. The method of claim 1, characterized in that said bending template drive (33) is positively controlled and the position signal (PS1) corresponding to said bending template drive (33) is used as the reference input for the pushing device drive (22), and that the processing of the position signals (PS1, PS2) is done with varying parameters in dependence on the position signal (PS1) forming said reference input.

4. The method of claim 1, characterised in that a target position of said pushing device (17) is kept smaller than the actual position of said bending template (10) until the position signal (PS1) of said bending template (10) has reached a predetermined value ($S_1$), and is then controlled to take a value that is greater than the actual position (PS1) of said bending template (10).

5. The method of claim 1, characterised in that the processing of said position signals (PS1, PS2) is variable in dependence on settable parameters of said pipe (13) or said bending template (10).

6. A pipe bending machine for pressure bending a pipe (13), comprising a bending template (10) rotatable by a first drive (33) and a clamping jaw (15) pressing a pipe (13) against said bending template (10), a pushing device (17) driven by a hydraulic second pipe (22) and engaging an unbent portion (13*a*) of said pipe (13), position sensors (32, 30) for detecting the positions of said bending template (10) and said pushing device (17), respectively; and control means (41) for changing one of the second drive (22) of said pushing device (17) and the first drive (33) of said bending template (10) in dependence on measured values obtained from position signals (PS1, PS2) of said respective bending template sensor (32) and said pushing device sensor (30), respectively; and said control means (41) is constructed and arranged for calculating the difference between said position signals (PS1, PS2) and controlling a pressure controller (42) in dependence upon the difference of the position signals (PS1, PS2) to change the supply pressure of one of said first and second drives (33, 22).

7. The pipe bending machine of claim 6, characterized in that said first drive (33) of said bending template (10) is positively controlled and the position signal (PS1) of said bending template (10) forms a reference input for the second drive (22) of said pushing device (17), and said control means (41) includes a function memory (FS) with different regions of positions of said bending template (10) being associated with different position values (Δs) of said function memory (FS) that are used when said regions are reached to generate said actuation signal (SS) for said pressure controller (42).

* * * * *